US006591650B2

(12) United States Patent
Engel et al.

(10) Patent No.: US 6,591,650 B2
(45) Date of Patent: Jul. 15, 2003

(54) HIGH-PRESSURE BULGE-FORMING APPARATUS

(75) Inventors: Bernd Engel, Burbach (DE); Michael Schierz, Freudenberg (DE); Matthias Prier, Wilnsdorf (DE)

(73) Assignee: Schuler Hydroforming GmbH & Co. KG, Wilnsdorf-Wilden (DE)

( * ) Notice: Subject to any disclaimer, the term of this patent is extended or adjusted under 35 U.S.C. 154(b) by 0 days.

(21) Appl. No.: 10/007,505

(22) Filed: Nov. 5, 2001

(65) Prior Publication Data

US 2002/0056305 A1 May 16, 2002

(30) Foreign Application Priority Data

Nov. 15, 2000 (DE) ..... 100 56 610

(51) Int. Cl.[7] ..... B21D 9/15; B21D 26/02
(52) U.S. Cl. ..... 72/58; 72/62; 29/890.149
(58) Field of Search ..... 72/58, 61, 62; 29/890.149

(56) References Cited

U.S. PATENT DOCUMENTS 2,837,810 A * 6/1958 Ekhom ..... 29/890.149
5,233,854 A * 8/1993 Bowman et al. ..... 72/58
5,445,002 A * 8/1995 Cudini et al. ..... 72/62
6,266,986 B1 * 7/2001 Morita et al. ..... 72/58
6,279,364 B1 * 8/2001 Morphy et al. ..... 72/58

OTHER PUBLICATIONS

"Anwendungsaspekte Beim Innenhochdruck–Umformen", F.Klaas; Werkstattstechnik 79 (1989) 210–214.
"Aufweitstauchen Von Rohren Durch Innenhochdruckumformen" F.Klaas;VDI Verlag, vol.2,No. 142; 12 pages.

* cited by examiner

*Primary Examiner*—David Jones
(74) *Attorney, Agent, or Firm*—Herbert Dubno; Andrew Wilford

(57) ABSTRACT

A high-pressure bulge-forming apparatus has a multipart die having a cavity adapted to receive a hollow workpiece and having ends oppositely open along an axis. Respective actuators aligned with the cavity ends have stems extending axially toward the cavity. Respective heads on the ends are engageable in the cavity with ends of the workpiece. One of the stems and the respective head is formed with a passage opening axially into the workpiece engaged by the respective head. Fasteners releasable secure the heads on the stems. Each head comprises an end part with an inwardly tapered outer surface and a base part fixed to the respective stem and carrying the respective head. In addition each head has a normally annular mounting plate between the respective base part and end part.

6 Claims, 2 Drawing Sheets

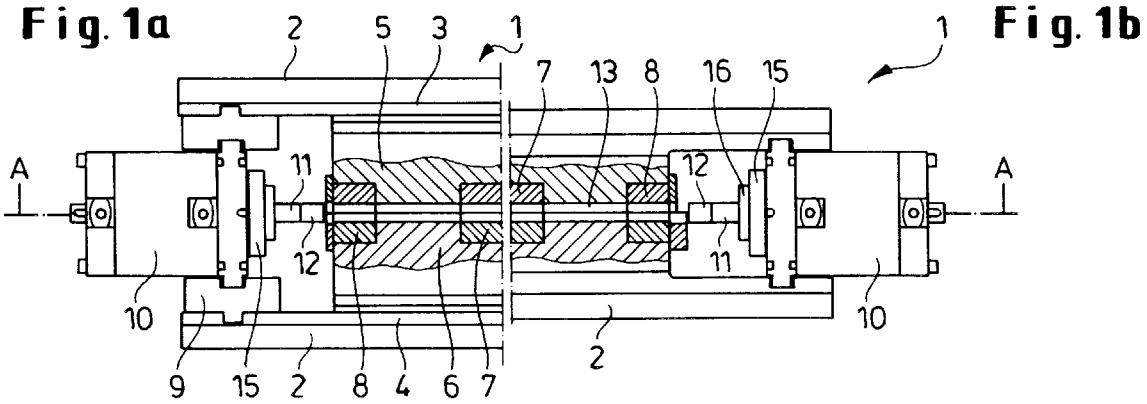
Fig. 1a
Fig. 1b
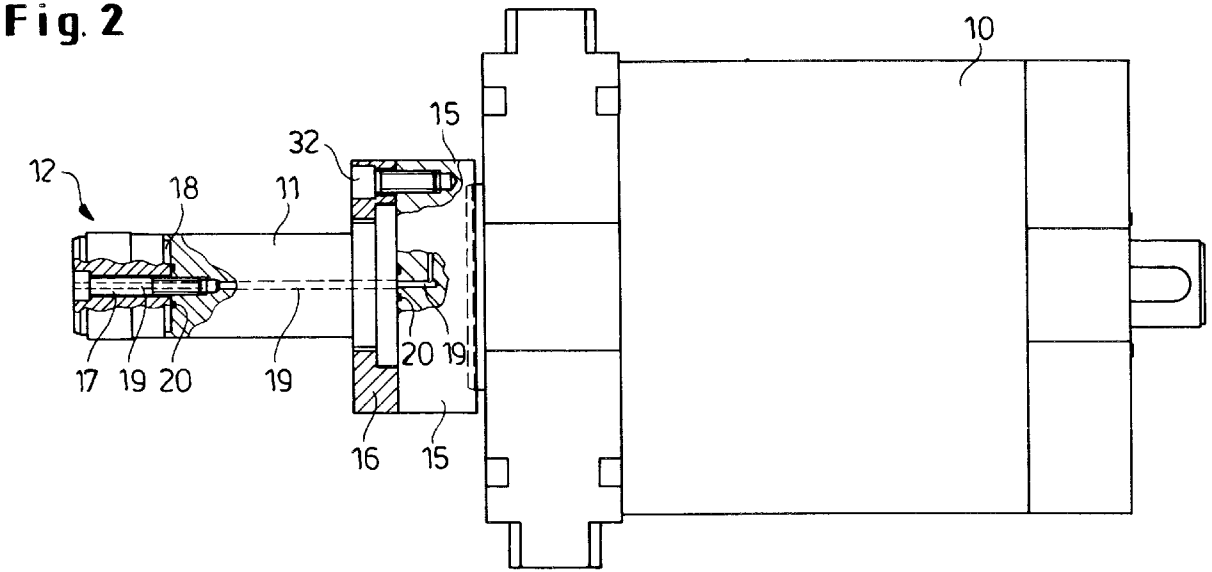
Fig. 2

HIGH-PRESSURE BULGE-FORMING APPARATUS

FIELD OF THE INVENTION

The present invention relates to a high-pressure bulge-forming apparatus. More particularly this invention concerns such and apparatus for producing complexly shaped hollow articles from a normally tubular workpiece.

BACKGROUND OF THE INVENTION

It is known to bulge-form a tubular workpiece with an apparatus that has a stationary base, a die fixed on the base and formed with a cavity having an inner surface and axially oppositely open ends. A tubular workpiece can be held in the cavity with ends of the workpiece exposed at the ends of the cavity. A pair of pistons can be fitted to the workpiece ends in the cavity. Respective actuators displace the pistons toward each other and against the ends of the workpiece in the cavity. A hydraulic liquid is fed at high pressure through one of the pistons to an interior of the workpiece in the cavity to deform the workpiece. In this manner, as described in "Werkstatttechnik 79 (1989)" (VDI-Fortschrittsberichte, vol 2, no 142, VDI-Verlag 1987) it is possible to deform the normally tubular workpiece into a complexly shaped finished article whose outer surface conforms exactly to the inner surface of the die and whose inner surface is very smooth.

Normally the die is made in two parts and the workpiece, of steel or copper, is a simple cylindrical tube laid in the die cavity. The inner ends of the pistons are constructed to seal tightly against the ends of the tube, and normally the pistons are advanced coaxially inward as the workpiece is deformed, since typically it shortens somewhat as it expands radially outwardly.

Each forming operation therefore requires that the two pistons move axially into and out of the ends of the die cavity while exerting considerable axial force against the workpiece on the inward stroke. As a result of the considerable wear, the service life of such pistons is regrettably short. Thus changing them for new ones not only entails a considerable expense for the new parts, but considerable down time for the equipment while the relatively massive and moderately complex parts are swapped out with fresh ones. Similarly when the die and/or workpiece shape change, the pistons must be changed to accommodate the new size and/or shape.

OBJECTS OF THE INVENTION

It is therefore an object of the present invention to provide an improved high-pressure bulge-forming apparatus.

Another object is the provision of such an improved high-pressure bulge-forming apparatus which overcomes the above-given disadvantages, that is which can be easily and inexpensively refitted when the pistons are worn or workpiece format changes.

SUMMARY OF THE INVENTION

A high-pressure bulge-forming apparatus has according to the invention a multipart die having a cavity adapted to receive a hollow workpiece and having ends oppositely open along an axis. Respective actuators aligned with the cavity ends have stems extending axially toward the cavity. Respective heads on the ends are engageable in the cavity with ends of the workpiece. One of the stems and the respective head is formed with a passage opening axially into the workpiece engaged by the respective head. Fasteners releasable secure the heads on the stems.

Thus when the heads become worn or workpiece format changes, the heads can be swapped out for new ones. Since the stems and heads are completely withdrawn from the die between work cycles, they are fully exposed and it is relatively easy to unfasten the heads and switch them for new ones.

Each head according to the invention comprises an end part with an inwardly tapered outer surface and a base part fixed to the respective stem and carrying the respective head. In addition each head has a normally annular mounting plate between the respective base part and end part. Each mounting plate forms a shoulder axially engageable with the respective end of the workpiece. Alternately each end plate forms a shoulder axially engageable with the respective end of the workpiece.

The end part and mounting plate in accordance with the invention are hardened. They may be made of a particularly wear-resistant material such as bronze or a bronze alloy, e.g. Gz-CuAlBzNi or AMPCO 25. Such materials will slide particularly smoothly into the workpiece to be deformed. In addition the base part is formed of such a highly wear-resistant material.

BRIEF DESCRIPTION OF THE DRAWING

The above and other objects, features, and advantages will become more readily apparent from the following description, reference being made to the accompanying drawing in which:

FIGS. 1*a* and 1*b* show opposite ends of high-pressure bulge-forming apparatuses according to the invention;

FIG. 2 is a large-scale view of an actuator and piston assembly in accordance with the invention;

SPECIFIC DESCRIPTION

Figure 3:
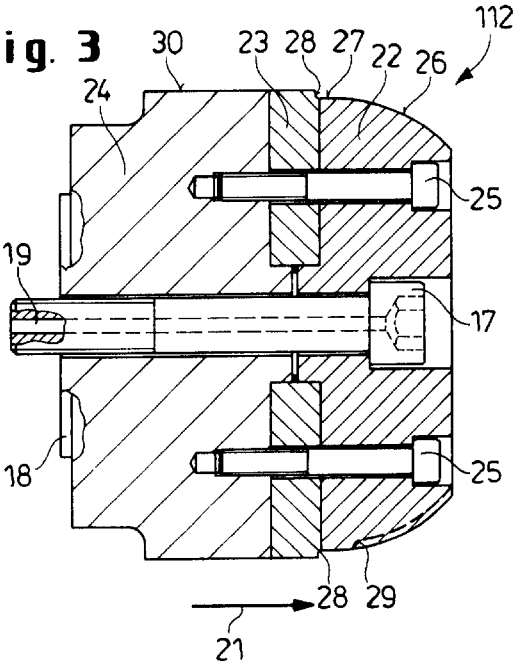
FIG. 3 is an axial section through a piston head according to the invention.
Figure 5:
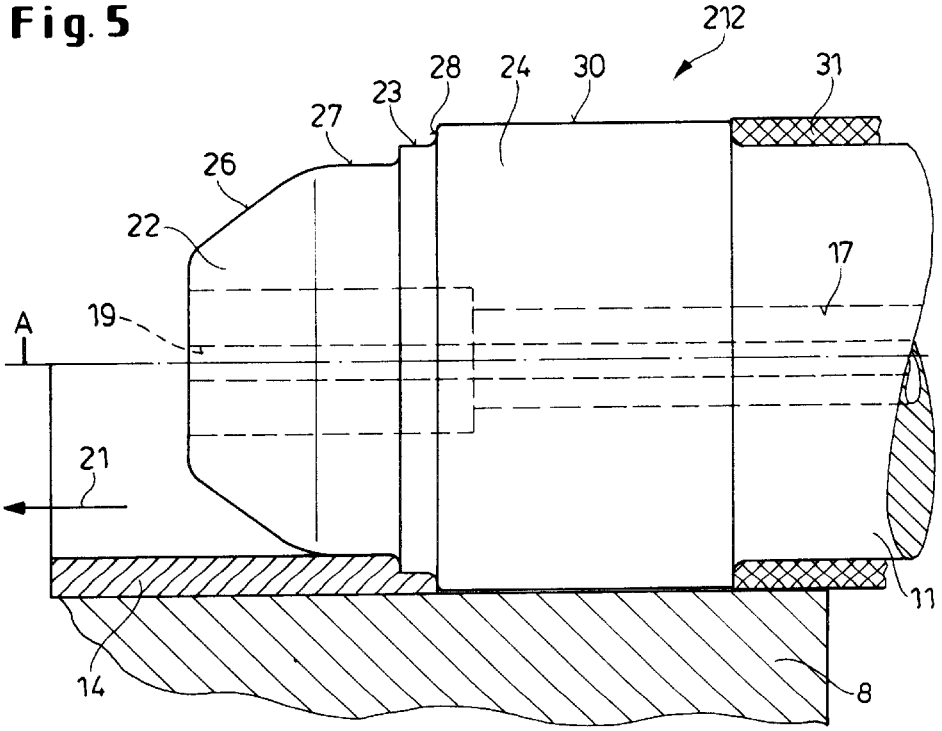
FIG. 5 is a side partly sectional detail view of a piston head and die in accordance with the invention.

As seen in FIGS. 1*a* and 1*b* die assemblies 1 according to the invention each have upper and lower base plates 3 and 4 and/or guides 2 holding die halves 5 and 6 in turn holding inner and outer die parts 7 and 8. Actuators 11 carried on support fittings 9 and aligned along an axis A have heads fittable into a cavity 13 formed by the die halves 5 and 6 and extending along the axis A, with a workpiece 14 (FIG. 5) engaged in the cavity 13 between the heads 12. During high-pressure formation the heads 12 are pressed inward as indicated in FIGS. 3 and 5 by arrow 21 against the ends of the workpiece 14 and a liquid is fed at very high pressure through a passage 19 (FIG. 2) into the workpiece 14 to expand it outward. During this radial expansion the workpiece 14 typically shortens somewhat axially, movement that is compensated for by moving the heads 12 axially inward toward each other. This is all substantially standard.

As shown in FIG. 2 each actuator 10 has mounting plate 15 to which a stem 11 is secured by a retaining ring 16 held in place by bolts 32. The stem 11 carries the respective head 12 which is secured in place by an axially extending tubular bolt 17 also forming the outer end of the passage 19. The inner end of the head 12 has a formation 18 projecting into a complementary recess on the outer end of the stem 11 to prevent canting of the head 12 relative to the axis A. The passage 19 extends axially from the plate 15 through the stem 11 and then through the bolt 17 so that liquid can be fed under high pressure into the workpiece 14. Seals 20 between the parts 15, 11, and 12 prevent leakage from the passage 19 which forms part of a means for supplying fluid under pressure to the hollow interior of the workpiece.

Figure 4:
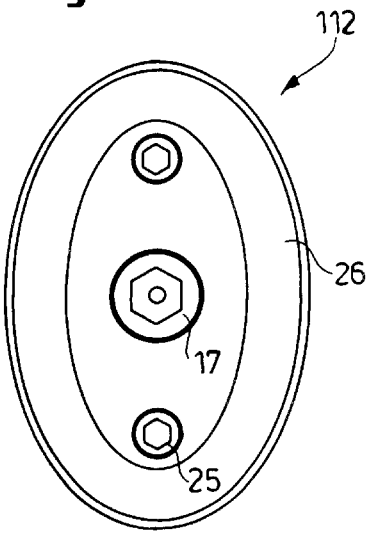
FIG. 4 is an end view of the piston head of FIG. 3.

As shown in FIGS. 3 and 4 a head 112 can comprise a base part 24 having the centering formations 18 and fitted with a mounting ring 23 to which in turn is mounted a shaped outer end part 22 secured to the part 24 by bolts 25 extending through the mounting ring 23. A front portion 26 of an outer surface of the end part 22 is beveled or curved inward to easily fit in the end of the workpiece 14 and a rear portion 27 is cylindrical and terminates at a sealing shoulder 28 that is planar and that flatly engages the workpiece end.

FIG. 5 shows how the base part 24 of a head 21 has a cylindrical outer surface 30 that rides inside the bore forming the cavity 13 at a slight spacing from its inner surface. To this end a guide bushing 31 is provided outward of the head 212 on the stem 11 to keep it centered in the cavity 13 and minimize wear. Here the base part 24, not the plate or ring 23, forms the shoulder 28.

We claim:

1. A high-pressure bulge-forming apparatus for a tubular workpiece having oppositely open ends, the apparatus comprising:

a multipart die forming a cavity adapted to receive the tubular workpiece and having cavity ends oppositely open along an axis;

respective actuators aligned with the cavity ends and having stems extending axially toward the cavity;

respective heads wholly engageable in the cavity ends and each having an end part with an inwardly tapered outer surface fittable inside the respective workpiece end and a base part fixed to the respective stem, guided in the respective cavity end, and carrying the respective end part, each of the heads being formed adjacent the respective tapered outer surface with a shoulder engageable axially with the respective workpiece end, one of the stems and the respective head being formed with a passage opening axially into the workpiece end engaged by the respective head; and fasteners releasable securing the heads on the stems.

2. The high-pressure bulge-forming apparatus defined in claim 1 wherein each head further comprises a mounting plate between the respective base part and end part.

3. The high-pressure bulge-forming apparatus defined in claim 2 wherein the end part and mounting plate are hardened.

4. The high-pressure bulge-forming apparatus defined in claim 2 wherein each mounting plate forms the respective shoulder.

5. The high-pressure bulge-forming apparatus defined in claim 2 wherein each base part forms the respective shoulder.

6. The high-pressure bulge-forming apparatus defined in claim 1 wherein the base part is formed of a highly wear-resistant material.

* * * * *